United States Patent [19]

Ross et al.

[11] Patent Number: 4,831,273

[45] Date of Patent: May 16, 1989

[54] MAILING MACHINE SENSING DEVICE

[75] Inventors: William A. Ross, Darien; William D. Toth, Milford; Gerald C. Freeman, Norwalk, all of Conn.

[73] Assignee: Pitney Bowes Inc., Stamford, Conn.

[21] Appl. No.: 114,329

[22] Filed: Oct. 29, 1987

[51] Int. Cl.[4] ..... B65H 7/14

[52] U.S. Cl. ..... 250/561; 101/233; 250/223 R; 271/258

[58] Field of Search ..... 250/561, 223 R, 222.1; 101/233–236, 242; 271/258

[56] References Cited

U.S. PATENT DOCUMENTS

| | | | |
|---|---|---|---|
| 3,041,462 | 6/1962 | Ogle . | |
| 3,676,691 | 7/1972 | Nordine | 101/233 |
| 3,882,308 | 5/1975 | Daughton et al. . | |
| 4,020,616 | 5/1977 | Nakajima et al. . | |
| 4,331,879 | 5/1982 | Gersl . | |
| 4,607,833 | 8/1986 | Svyatsky et al. | 271/258 |

*Primary Examiner*—Edward P. Westin

*Attorney, Agent, or Firm*—Lawrence E. Sklar; David E. Pitchenik; Melvin J. Scolnick

[57] ABSTRACT

A mailing machine system, including a mailing machine base and a feeder module secured to the base for conveying envelopes toward a postage meter secured to the base. The feeder module includes a horizontal feed deck and a vertical registration wall adjacent the feed deck and forming a right angle therewith. The system also includes an automatic override circuit for turning the mailing machine system on and off at particular times depending upon the presence or absence of an envelope on the feed deck, and a sensing device having an emitting element and a receiving element. One of the elements is situated in the feed deck and the other of the elements is situated in the registration wall. The sensing device is operatively connected to the on-off circuit, wherein the detection by the sensing device of the presence of an envelope causes the mailing machine system to be turned on and the lack of detection by the sensing device for a predetermined period of times causes the mailing machine system to be turned off.

5 Claims, 2 Drawing Sheets

MAILING MACHINE SENSING DEVICE

BACKGROUND OF THE INVENTION

The instant invention relates to mailing machines, and more particularly to mailing machines which are automatically turned on and off depending upon whether or not an envelope is present on the feed deck thereof for processing to a postage meter situated downstream of the feed deck.

There are now being developed for mailing machines electronic systems which automatically turn on the mailing machine in response to an envelope entering the machine and which, after a set amount of time when no other envelope has been fed thereto, turn off the mailing machine, thereby reducing electrical power consumption and noise. Such an automatic on/off system will utilize in-line sensors to detect the presence or absence of envelopes. Many mailing machines being marketed today include the capability of printing indicia on envelopes fed seriatim manually thereto or automatically from a stack placed on a feed deck. In order to provide a mailing machine with an automatic on/off system which can accommodate both manual and automatic feeding, a sensor is required which can sense the presence of a single envelope at a given location, as well as a stack of envelopes at same given location without the stack height being limited by the physical limitations of the sensor.

Accordingly, the instant invention provides a sensor which can be utilized in an automatic on/off mailing machine capable of processing manually fed envelopes as well as envelopes fed automatically from a stack of envelopes stored in a supply hopper and which imposes no limitation on the height of the stack of envelopes stored in the supply hopper.

SUMMARY OF THE INVENTION

The instant invention provides a mailing machine system, comprising a mailing machine base, and a feeder module secured to the base for conveying envelopes toward a postage meter secured to the base. The feeder module includes a horizontal feed deck and a vertical registration wall adjacent the feed deck and forming a right angle therewith. The mailing machine system further includes an automatic override circuit for turning the mailing machine system on and off at particular times depending upon the presence or absence of an envelope on the feed deck, and a sensing device having an emitting element and a receiving element, one of said elements being situated in the feed deck and the other of said elements being situated in the registration wall. The sensing device is operatively connected to the on-off circuit, wherein the detection by the sensing device of the presence of an envelope causes the mailing machine to be turned on and the lack of detection by said sensing device for a predetermined period of time causes said mailing machine to be turned off.

DETAILED DESCRIPTION OF THE PREFERRED EMBODIMENT

Figure 1:
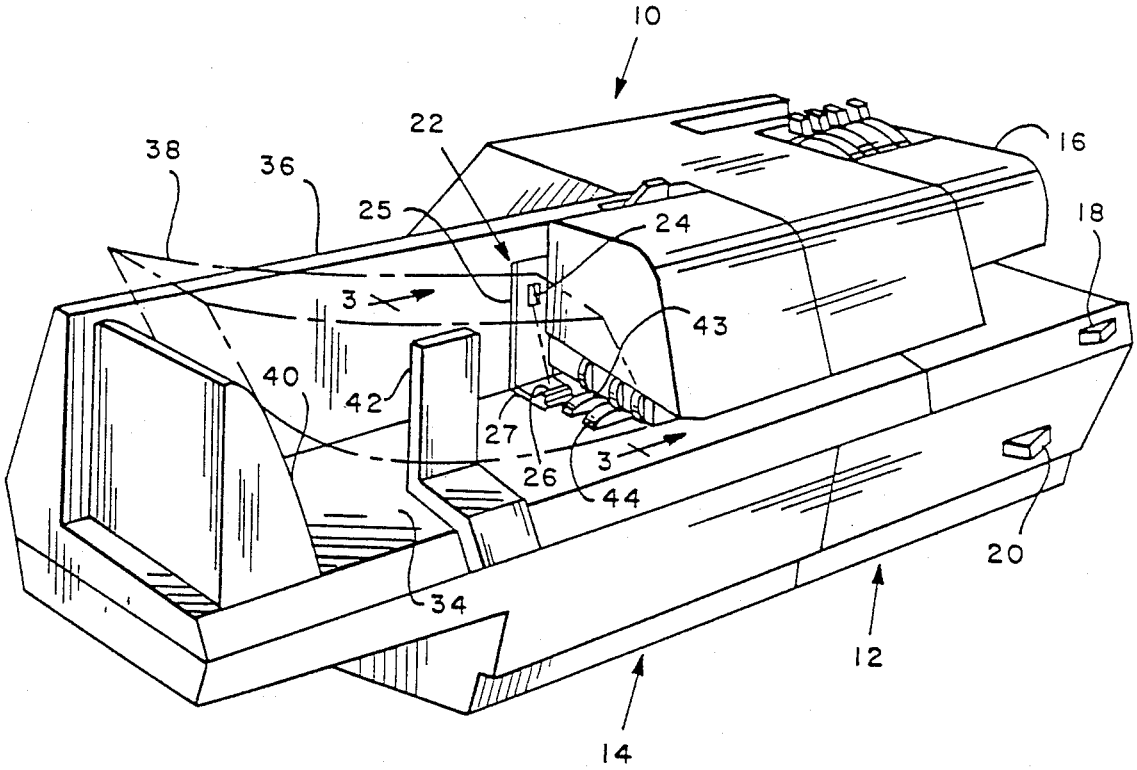
FIG. 1 is a perspective view of a mailing machine system having an automatic feeding module incorporating the sensing device in accordance with the instant invention, and showing a stack of envelopes to be fed automatically to a postage meter.

In describing the preferred embodiment of the instant invention, reference is made to the drawings, wherein there is seen in FIG. 1 a mailing machine system generally designated 10 consisting of a mailing machine base 12 and an automatic feeder module 14 electrically and physically connected thereto. The mailing machine base 12 has mounted thereon in conventional manner a postage meter 16 which is capable of printing the desired amount of postage on an envelope passing thereunder. The base 12 includes a conventional on/off switch 18 which, when it is in the on position, maintains the mailing machine system 10 permanently on until such time as the switch 18 is turned to the off position, at which time the entire system 10 is turned off. The base 12 further includes an override switch 20 which, when in the off position, permits the on/off switch 18 to function normally, but when the override switch 20 is in the on position, the on/off switch 18 is bypassed and operation of the system 10 is governed solely by the override switch 20 which turns the system 10 on in response to the presence of envelopes on the feeder module 14 and which turns the system 10 off after a predetermined period of time has elapsed without an envelope being placed on the feeder module 14, as will be explained in further detail hereinafter.

Figure 3:
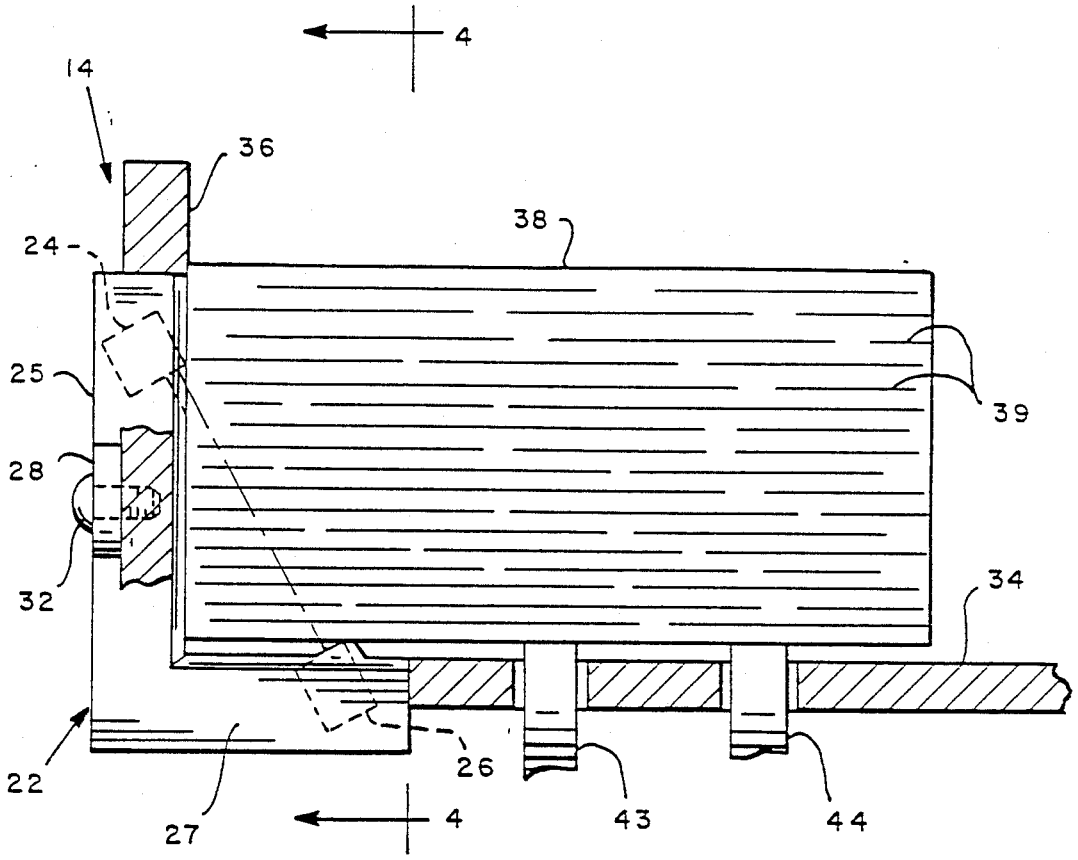
FIG. 3 is a sectional view taken on the vertical plane indicated by the line 3—3 in FIG. 1.
Figure 4:
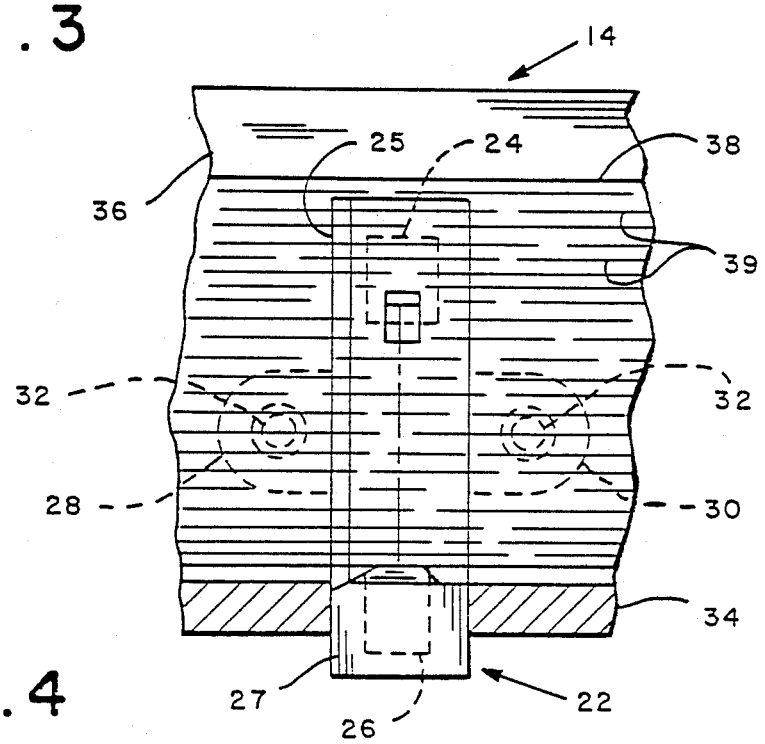
FIG. 4 is a sectional view taken on the vertical plane indicated by the line 4—4 in FIG. 3.

Situated on the automatic feeder module 14 is a sensing device 22 which is a right-angled and electrically connected to the control board (not shown) for the mailing machine system 10. The sensing device 22 includes an emitter 24 located in the vertically extending portion 25 of the device 22 and a detector 26 located in the horizontal portion 27 of the device 22 and arranged so that the electromagnetic radiation (typically infrared) emitted by the emitter 24 passes at a preferred angle of 30 degrees to a vertical plane toward the detector 26. The sensing device 22 is secured to the feeder module 14 by eans of a pair of ears 28 and 30 extending from the sides of the vertically extending portion 25 of the sensing device 22 and screws 32 extending therethrough. It can be seen in FIG. 3 that the detector 26 projects upward through the deck 34 of the feeder module 14. Such a projection allows the detector 26 to be oriented perpendicular to the radiation emitted from the emitter 24, thereby minimizing reflection, refraction, and losses resulting therefrom. Another advantage of the that it prevents dust from accumulating on the detector 26 which would be the case were it to be recessed in the deck 34. Because the sensing device 22 is right-angled, it fits into the feeder deck 34 and the registration wall 36 of the feeder module 14 without in any way obstructing the flow path of envelopes passing therethrough.

In the operation of the embodiment seen in FIG. 1, a stack 38 of envelopes 39 is taken by an operator from a source (not shown), manually flexed to produce a shingled relationship between the envelopes 39 as represented by the phantom lines of the stack 38 in FIG. 1 and then placed on the deck 34 as seen in FIG. 1 with the trailing end of the stack 38 separated from the deck 34 owing to support from a longitudinally adjustable guide support 40. The stack 38 is urged against the registration wall 36 by an adjustable flange 42. Placement of the stack 38 on the deck 34 results in the stack 38 blocking the transmission of light or other form of electromagnetic radiation from the emitter 24 to the detector 26, thereby causing the mailing machine system 10 to be turned on in response to the presence of sealed envelopes 39 on the deck 34. Bottom feed rollers 43 and 44 remove the lowermost envelope 39 from the stack 38 in conventional manner and feed the envelopes 39 toward the postage meter 16 for printing of postage indicia. It can be seen that the sensing device 22, owing to its right-angled configuration, imposes no limit on the height of the stack 38, the only limit on the height of the stack 38 being that imposed by the structure of the feeder module 14. The mailing machine system 10 will stay on for a predetermined period of time after the last envelope 39 in the stack 38 has been fed, typically about three seconds, after which the system 10 is completely turned off.

Figure 2:
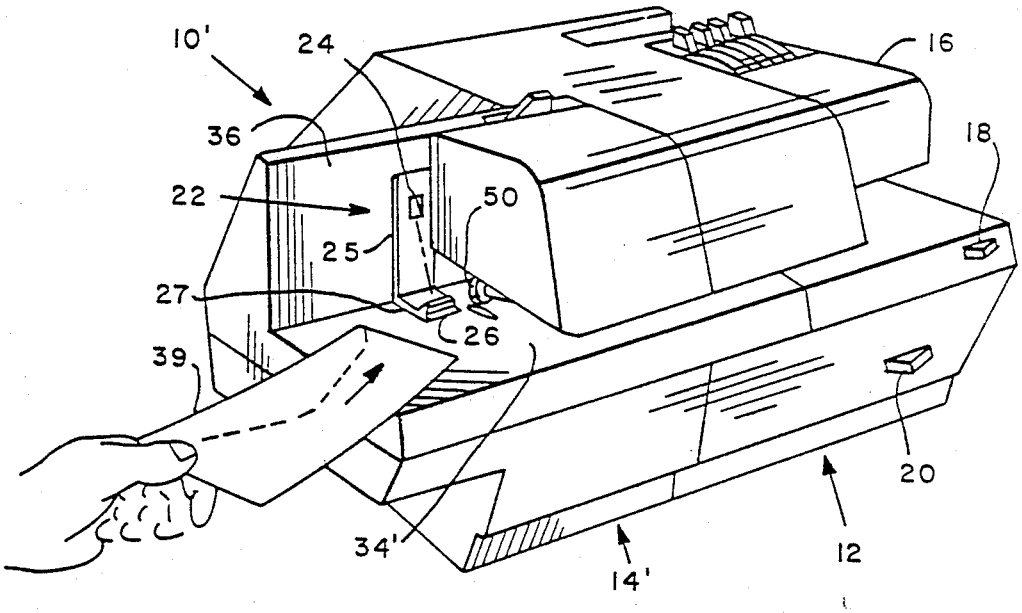
FIG. 2 is the same as FIG. 1 except that the automatic feeding module has been replaced by a manual feeding module, and a single sealed envelope is shown being fed to the mailing machine manually.

In FIG. 2 is seen a mailing machine system 10′ consisting of the same structural components as the system 10 seen in FIG. 1 except that the feeder module 14 in the system 10 of FIG. 1 has been replaced by a manual feeding module 14′. In the embodiment of FIG. 2, an envelope 39 is fed manually to the feed deck 34′, and upon the envelope 39 traversing the sensing device 22, the system 10′ is turned on, and a feed wheel 50 feeds the envelope 39 through the system 10′ to the postage meter 16 for printing of the postage indicia in conventional manner.

From the foregoing description, it can be seen that the sensing device 22 is capable of accommodating both manual and automatically fed envelopes 39 and permits the mailing machine system 10 to be turned on in response to the presence of sealed envelopes 39 on the feed deck. Moreover, there is no limit to the height of the stack 38 of envelopes 39 when the automatic feeder module 14 is employed. It should be noted that the envelope 39 may be sealed or unsealed.

The above embodiments have been described by way of illustration only, and those skilled in the art will recognize many other embodiments from the above descriptions and the attached drawings. Accordingly, limitations on the subject invention are to be found only in the claims set forth hereinbelow.

What is claimed is:

1. A mailing machine system, comprising:

a mailing machine base;

a feeder module secured to said base for conveying envelopes toward a postage meter secured to said base, said feeder module having a horizontal feed deck and a vertical registration wall adjacent said feed deck and forming a right angle therewith;

an automatic override circuit for turning the mailing machine system on and off at particular times depending upon the presence or absence of an envelope on said feed deck; and a sensing device having an emitting element and a receiving element, one of said elements being situated in said feed deck and the other of said elements being situated in said registration wall, said sensing device being operatively connected to said on-off circuit, wherein the detection by said sensing device of the presence of an envelope causes said mailing machine system to be turned on and the lack of detection by said sensing device for a predetermined period of time causes said mailing machine system to be turned off.

2. The mailing machine system of claim 1, wherein said feeder module comprises an automatic module including means for automatically feeding seriatim said envelopes from a stack of said sealed envelopes.

3. The mailing machine system of claim 2, additionally comprising an on-off circuit for turning the system permanently on or off, said automatic, override circuit able to override said on-off circuit.

4. The mailing machine system of claim 1, wherein said feeder module comprises a manual feeding module including means for feeding seriatim envelopes manually located on said manual feeding module.

5. The mailing machine system of claim 4, additionally comprising an on-off circuit for turning the system permanently on or off, said automatic, override circuit able to override said on-off circuit.

* * * * *